US011428019B2

(12) United States Patent
Sighinolfi

(10) Patent No.: US 11,428,019 B2
(45) Date of Patent: Aug. 30, 2022

(54) LEVELLING SPACER DEVICE

(71) Applicant: RAIMONDI S.P.A., Modena (IT)

(72) Inventor: Riccardo Sighinolfi, Rubiera (IT)

(73) Assignee: RAIMONDI S.P.A., Modena (IT)

( * ) Notice: Subject to any disclaimer, the term of this patent is extended or adjusted under 35 U.S.C. 154(b) by 0 days.

(21) Appl. No.: 17/184,858

(22) Filed: Feb. 25, 2021

(65) Prior Publication Data

US 2022/0154475 A1 May 19, 2022

(30) Foreign Application Priority Data

Nov. 16, 2020 (IT) ..... 102020000027354

(51) Int. Cl.
*E04F 21/18* (2006.01)
*E04F 21/00* (2006.01)
*E04F 21/22* (2006.01)

(52) U.S. Cl.
CPC ..... *E04F 21/1877* (2013.01); *E04F 21/0092* (2013.01); *E04F 21/22* (2013.01)

(58) Field of Classification Search
CPC ..... B66F 1/06; B66F 1/04; B66F 1/00; E04F 21/1877; E04F 21/22; E04F 21/1844; E04F 21/0092; E04F 13/0892; E04F 15/02005
USPC ..... 52/749.11, 747.11, 126.7, 127.7; 248/354.6, 354.7; 254/12, 95, 97, 254/108–112
See application file for complete search history.

(56) References Cited

U.S. PATENT DOCUMENTS 10,801,218 B2 * 10/2020 Cipriani ..... E04F 21/0092
2013/0067854 A1 * 3/2013 Bordin ..... E04F 15/02022 52/749.11
2015/0211243 A1 * 7/2015 Irvine ..... E04F 21/22 52/126.1
2016/0369518 A1 * 12/2016 Sarajian ..... E04F 15/08
2019/0093372 A1 * 3/2019 Russo ..... E04F 21/18
(Continued)

FOREIGN PATENT DOCUMENTS

EP 2573296 A1 3/2013
EP 3147423 A1 * 3/2017 ..... E04F 21/0092
WO WO-2019071308 A1 * 4/2019 ..... E04F 13/0892

OTHER PUBLICATIONS

Italian Search report and written opinion issued for the Italian priority application No. 102020000027354 dated Jul. 20, 2021.

*Primary Examiner* — Babajide A Demuren
(74) *Attorney, Agent, or Firm* — Browdy and Neimark, PLLC

(57) ABSTRACT

A levelling spacer device for the application of slabs for covering surfaces, including a base having a lower surface and an opposite upper surface, a separator element extending upwardly from the upper surface of the base, a threaded stem which rises up from the separator element, a pressing element able to screw into the threaded stem, and a corner spacer that rises up from the upper surface of the base. The separator element includes a main zone having side faces parallel to one another and spaced apart defining a first thickness of the main zone. The corner spacer includes two side edges parallel to one another and square-angled with respect to the side faces. The separator element includes a central zone proximal to the base having a non-zero second thickness smaller than the first thickness. The corner spacer joins the central zone and has a longitudinal axis perpendicular to the side faces.

10 Claims, 7 Drawing Sheets

(56) References Cited

U.S. PATENT DOCUMENTS

| | | | | |
|---|---|---|---|---|
| 2019/0242143 | A1* | 8/2019 | Dahill | E04F 15/02022 |
| 2019/0271167 | A1* | 9/2019 | Ghelfi | E04F 21/1877 |
| 2019/0345724 | A1* | 11/2019 | Sighinolfi | E04F 21/1877 |

* cited by examiner

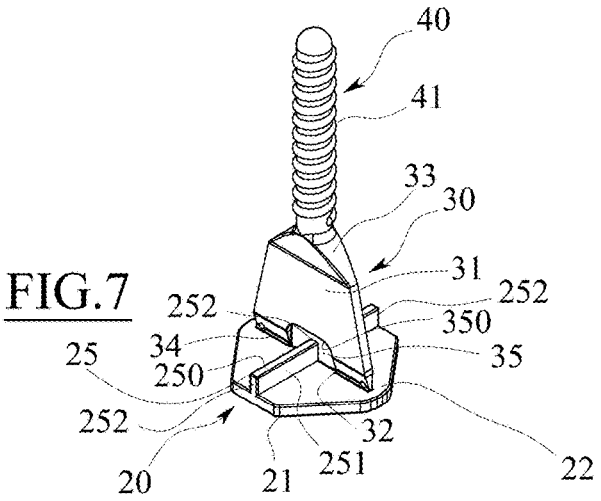
FIG.7
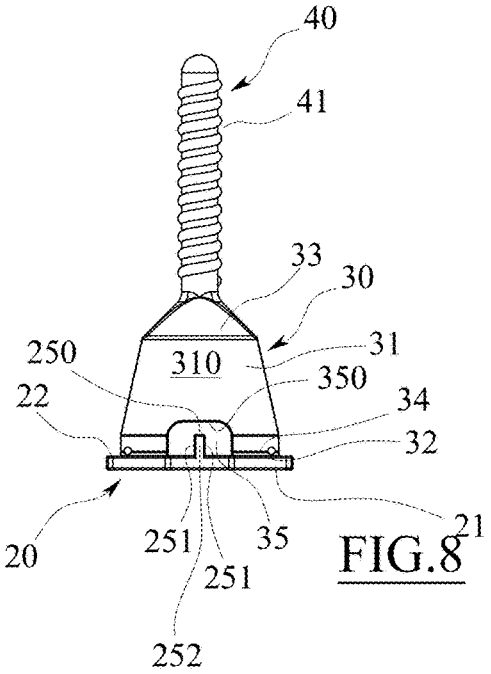
FIG.8
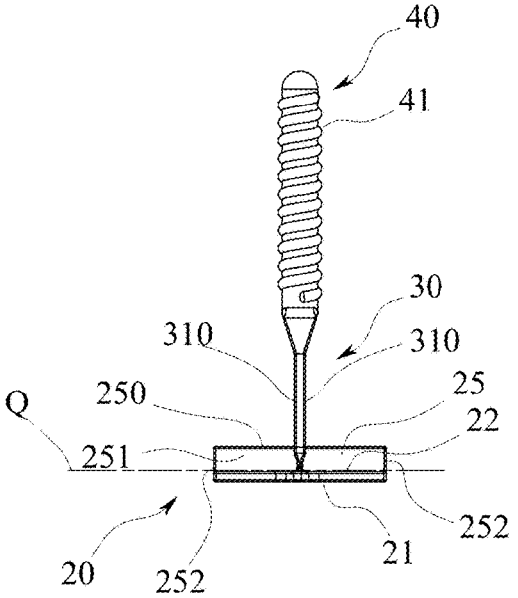
FIG.9
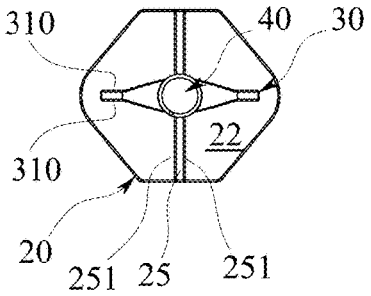
FIG.10
FIG.26
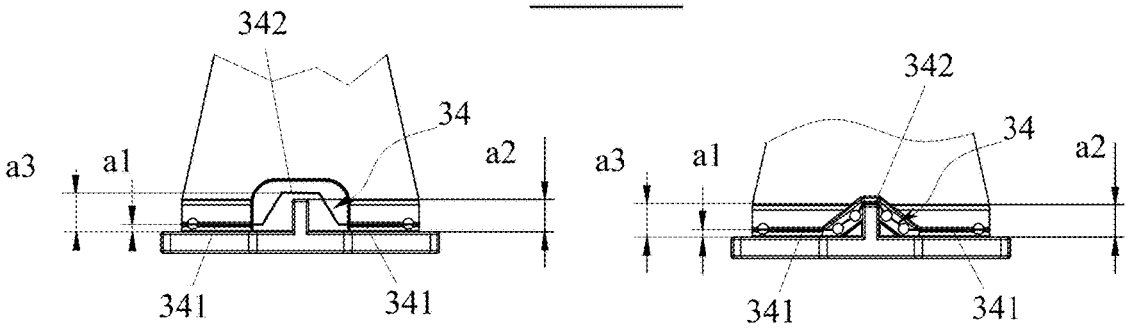

LEVELLING SPACER DEVICE

TECHNICAL FIELD

The present invention relates to a levelling spacer device for the installation of slab-like manufactured products, such as tiles, slabs of natural stone or the like, for covering surfaces, such as walkable surfaces, floors, wall o ceiling coverings or the like.

PRIOR ART

In the field of the installation of tiles for covering surfaces, such as flooring, walls and the like, the use of spacer devices is known which, in addition to spacing the tiles, allow their planar arrangement, that is, they are such as to make the visible surface of the tiles substantially coplanar; these devices are commonly called levelling spacers.

Known levelling spacer devices generally comprise a base, which can be positioned below the installation surface of at least two (three or four) adjacent tiles, from which at least one separator element rises, able to contact, through its side edges, the facing edges of the two (three or four) tiles to be placed side by side on the installation surface, defining the width of the joint between the tiles.

The levelling spacer device is also provided with a pusher element cooperating with the portion of the separator element which rises above the plane defined by the surface in view of the tiles. The pusher element is essentially provided with a planar surface turned towards the base which is adapted to press the surfaces in view of all the manufactured products supported by the same base towards the base itself so as to level the surfaces in view.

Among the levelling spacer devices of the known type there are various types, one of these types is that of the so-called "screw" levelling spacer devices, which provides that the pressing element is essentially constituted by a knob equipped with a spindle nut suitable for being screwed to a threaded stem (or similar) associated with the emerged portion of the separator element.

Once the pressing element has been screwed onto the threaded stem and has carried out its task of levelling the tiles, having waited for the adhesive on which the application surfaces of the tiles are applied to have consolidated, it is sufficient to separate—for example thanks with pre-established fracture lines suitably made between the separator element and the base—the separator element from the base, which will remain immersed in the concealed adhesive under the application surface of the tiles.

The levelling spacer devices, when they have to separate three or four tiles from each other, or when they have to be arranged at the edges of the tiles, can have a corner spacer.

The presence of said corner spacer, especially in screw levelling spacer devices, complicates the forming operations of the device, which is generally carried out by molding plastic materials.

In particular, the realisation of said corner spacers requires the production of complex molds which require means for moving parts (trolleys), which translate into an increase in costs and production times.

Furthermore, a felt need is to limit the deformability of the separator element under the screwing action of the pressing element.

An object of the present invention is to overcome the aforementioned drawbacks of the known art and to satisfy the aforementioned needs of the same, within the framework of a simple, rational and low cost solution.

Such objects are achieved by the characteristics of the invention given in the independent claim. The dependent claims outline preferred and/or particularly advantageous aspects of the invention.

DISCLOSURE OF THE INVENTION

The invention, in particular, provides a levelling spacer device for the installation of slab-like manufactured products for covering surfaces, comprising:

- a base having a lower surface and an opposite upper surface and defining a resting plane an application surface of at least two slab-like manufactured products that are adjacent and placed side by side with respect to a tiling direction;
- a separator element, which rises up from the upper surface of the base and is adapted to slot between facing side edges of said two slab-like manufactured products placed side by side along the tiling direction, wherein the separator element comprises a main zone provided with two side faces that are parallel to one another, perpendicular to the tiling direction and square-angled with respect to the resting plane, wherein a distance between the faces of the separator element defines a first thickness of the main zone of the separator element;
- a threaded stem that rises up from the separator element with screwing axis perpendicular to the resting plane;
- a pressing element able to screw into the threaded stem;
- at least one corner spacer that rises up from the upper surface of the base and is joined thereto and is adapted to come into contact with edges perpendicular to the facing edges of the slab-like manufactured products for the alignment thereof along a direction perpendicular to the tiling direction, wherein the corner spacer comprises two side edges that are parallel to each other, perpendicular to the resting plane and square-angled with respect to the faces of the main zone of the separator element;

wherein the separator element comprises a central zone proximal to the base and having a second thickness which is not zero and lower than the first thickness, wherein for example the central zone joins the main zone, for example by means of a step or a ramp (for example gradual, in which the thickness of the separator element gradually increases from the second thickness to the first thickness, or variously shaped); and wherein the corner spacer is joined to the central zone and has a longitudinal axis perpendicular to the faces of the main zone.

Thanks to this solution, the levelling spacer device, or the base thereof, can be of the type suitable to be positioned at the junction of three or four tiles, defining the interspace in a regular, constant and controlled way and—at the same time—can be made, for example by injection molding, in a simple and fast way, without requiring expensive and complicated measures and, at the same time, improving the torsional resistance of the separator element (without compromising the removability thereof upon fracture).

Furthermore, the central zone can surround on the perimeter, at least on three sides, an axial end of the corner spacer and is in turn surrounded on the perimeter, at least on one or two or three sides, by the main zone.

Furthermore, the central zone can extend in height, along a first direction perpendicular to the resting plane, up to a level higher than a maximum height of a top wall of the corner spacer with respect to the resting plane.

Advantageously, the central zone can extend in width, along a second direction parallel to the resting plane and perpendicular to the longitudinal axis of the corner spacer, for a width greater than a maximum thickness of the corner spacer defined by the distance between the two side edges of the corner spacer.

Furthermore, the main zone can comprise two legs which are joined to the base and laterally delimit the central zone, for example by means of a respective side portion of the step or ramp.

Furthermore, the main zone can comprise a crosspiece joined superiorly to the top of the legs which superiorly delimits the central zone by means of a respective upper portion of the step or ramp.

Advantageously, the separator element can exhibit a predetermined fracture line or section, wherein the predetermined fracture line or section, in turn, can be provided with two side stretches intersecting the main zone and joining the central zone, the maximum height of the side stretches is lower than a maximum height of a top wall of the corner spacer with respect to the resting plane.

Advantageously, then, the two side stretches of the predetermined fracture line or section are extended (axially) by a central stretch which propagates (freely and/or guided) along the central zone, for example along a propagation line which has a maximum height greater than the maximum height of a top wall of the corner spacer with respect to the resting plane (although contained within the central zone itself).

Therefore, the predetermined fracture line or section has a longitudinal development substantially of a broken line, formed by the two side stretches (substantially straight) and the central stretch (arched) which rises above the top wall of the corner spacer.

Preferably, the predetermined fracture line or section can exhibit a third thickness smaller than the first thickness (it is not excluded that the third thickness can also be smaller than the second thickness).

Advantageously, the third thickness can be greater than or equal to the second thickness.

According to a possible variant of the device according to the invention, the central zone can comprise at least one fracture guide element comprising a perimeter crossing guide hole contained in the central zone.

BRIEF DESCRIPTION OF THE DRAWINGS

Further features and advantages of the invention will be more apparent after reading the following description provided by way of non-limiting example, with the aid of the figures illustrated in the accompanying drawings.

FIG. 7 is an axonometric view of a base according to a first embodiment (in which the main zone has a first determined thickness).

FIG. 8 is a front view of FIG. 7.

FIG. 9 is a side view of FIG. 7.

FIG. 10 is a plan view from above of FIG. 7.

FIG. 26 is an enlarged detail of the bases of the first and second embodiments, in which the predetermined fracture line or section is highlighted.

BEST MODE OF THE INVENTION

Figure 1:
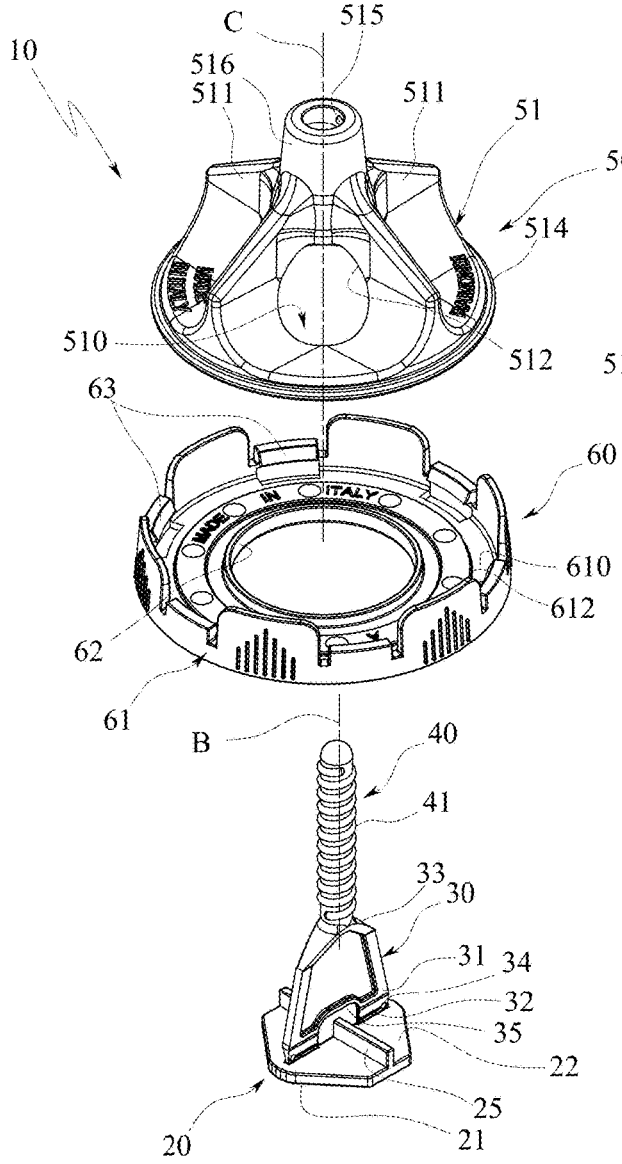
FIG. 1 is an axonometric exploded view of a levelling spacer device.
Figure 2:
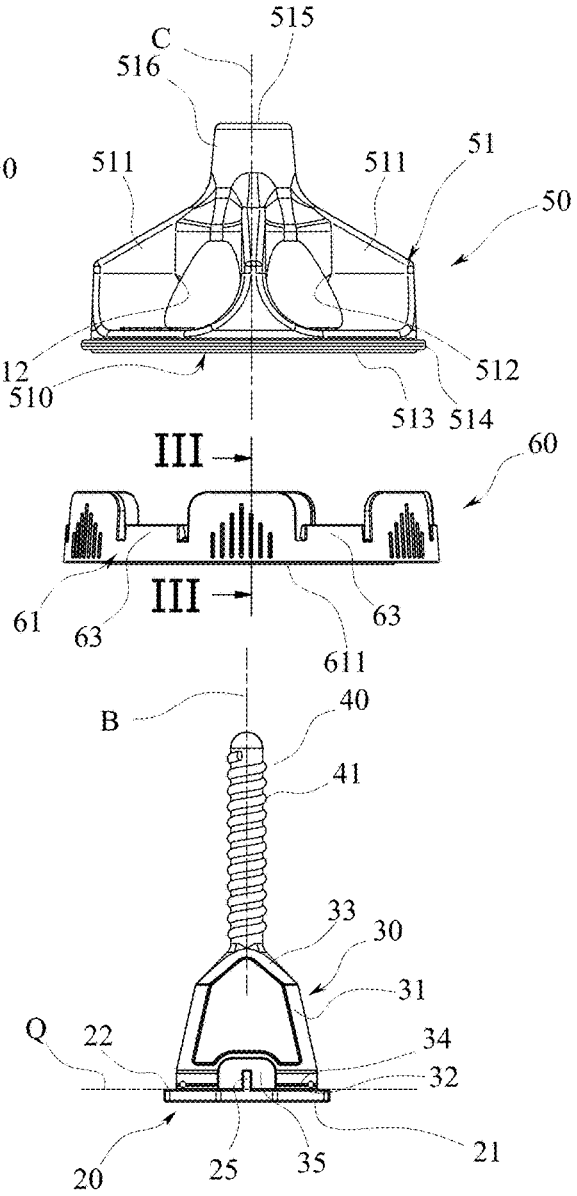
FIG. 2 shows a front view of FIG. 1.

With particular reference to these figures, the reference number 10 generally designates a levelling spacer device adapted to facilitate the installation of slab-like manufactured products, such as tiles and the like, generally indicated with letter P, and adapted for covering surfaces, i.e. flooring, walls, ceilings and the like.

Each tile P, adapted for being laid to cover a surface, has a wide installation surface P1, for example lower, and an opposite wide surface in view P2, for example upper, preferably of homologous shape (for example polygonal, preferably quadrangular) with respect to the installation surface P1.

Each tile P then comprises a plurality of side edges P3, generally square-angled (two by two and individually square-angled) with the installation surface P1 and the surface P2 in view, which laterally delimit the tile itself.

The device 10 comprises a base configured to space the tiles P placed side by side and act as a tie bar to be able to level them following a suitable levelling action.

The device 10, that is the base of the same, comprises a base 20, which is adapted in use to be placed behind the application surface P1 of the tiles P.

The base 20 in the illustrated example has an enlarged shape, for example polygonal, circular or of irregular shape.

In any case, the base 20 comprises a lower surface 21, for example flat or V-shaped, adapted to be arranged distant from the application surface P1 of the tiles P during operation, and an opposite upper surface 22, for example flat, adapted to be arranged proximal to the application surface P1 of the tiles P and, for example, in contact therewith.

The upper surface 22 of the base 20 (or at least a portion thereof) is in practice intended to receive for resting a portion of the lower (installation) surface 21 of one or more tiles P (side by side between them).

The upper surface 22, for this purpose, defines a resting plane Q.

The base 20 is adapted to be immersed in a layer of adhesive arranged on a screed which is intended to be covered by the tiles P, with the lower surface 21 turned towards the screed itself and the upper surface 22 turned towards the overlying tiles P.

The base 20, in the example shown, is defined by a monolithic body, for example made of a plastic material (obtained by injection moulding), which has a substantially polygonal (plan) shape.

The base 20, in the example shown, is a monolithic body which has an irregular (plan) shape, for example substantially octagonal.

The base 20 has a symmetrical shape with respect to a central (or median) plane perpendicular to the base itself, for example perpendicular with respect to the resting plane Q (in particular it is symmetrical with respect to both the median planes perpendicular to each other and perpendicular to the resting plane Q).

The base 20 can have, for example, a thickness at the central plane (with symmetry perpendicular to the longitudinal axis of the same) which is greater than a thickness of the same at the axial (opposite) ends and, for example decreasing from the central plane towards the axial ends.

In practice, this thickness gradient of the base 20 facilitates the person in charge of installing the tiles P to slot the base 20 below the application surface P1 of the tiles P when these are already resting on the adhesive layer.

The device 10, i.e. the base of the same, furthermore comprises a separator element 30 which rises in a square-angled way from the base 20, for example at the central (symmetry) plane of the same, which is adapted, in use, to slot between facing side edges P3 of at least two (or more) tiles P to be placed side by side along a tiling direction indicated in the figures with the letter A and contact them defining the width of the interspace (or joint) between the tiles P placed side by side (along said tiling direction A).

In practice, the separator element 30 rises (vertically) from the upper surface 22 of the base 20 in a square-angled manner therewith (perpendicular to the resting plane Q defined by it).

The separator element 30 is a slab-like body, for example, with a substantially rectangular (very narrow and long) base which defines a thin (and wide) separation wall that divides the upper surface 22 of the base 20 into two opposite portions (equal and symmetrical with respect to the separator element itself in the example).

The separator element 30 has a width (meaning by width the size of the separator element 30 perpendicular to the tiling direction A and parallel to the resting plane Q), which is smaller (or at most the same as) than the width of the base 20 (at the median plane on which the separator element itself lies).

The separator element 30 has zones of different thickness (meaning by thickness the size of the separator element 30 parallel to the tiling direction A).

For example, the separator element 30 comprises a main zone 31, which comprises two opposite faces 310 that are planar and parallel (to each other).

Each face 310 of the main zone 31 is perpendicular to the tiling direction A.

The mutual distance between the faces 310 defines a first (calibrated) thickness S1 of the separator element 30, which is the main thickness of the separator element 30, i.e. the one that defines (and is equal to) the width of the joint between the tiles P separated from it.

Each face 310 is perpendicular to (the resting plane Q defined by) the upper surface 22 of the base 20.

In practice, each tile P which rests on one of the two portions of (the resting plane defined by) the upper surface 22 of the base 20 is adapted to contact at least a portion of the faces 310 of the separator element 30.

Furthermore, the separator element 30 has a height (intended as the size along a direction perpendicular to the base 20) greater than the thickness of the tiles P to be laid, so that the top of the separator element 30, once the tiles P rest (with their own application surface P1) on the upper surface 22 of the base 20, protrude superiorly (abundantly) with respect to the plane to be levelled defined by the surface P2 in view (more distant from the upper surface 22) of the tiles P.

The main zone 31, in some cases (see FIGS. 1,2, 12-15 and 21-25), can delimit/separate a lightening zone having a further thickness lower than the first aforesaid thickness S, in the example the main zone 31 defines a frame which incorporates the lightening zone inside.

The separator element 30 has a lower end 32 preferably joined to the base 20 and an opposite free end 33 distal from the base 20.

The free end 33 can have, for example, upper walls sloping from the centre towards the opposite longitudinal ends and, for example, a central zone with an increased thickness with respect to the first thickness S1 (and the rest of the separator element 30).

The separator element 30 also comprises a central zone 35, proximal to the base 20.

The central zone 35 is centered in the width of the separator element 30, i.e. in a direction perpendicular to the tiling direction A and parallel to the upper surface 22 of the base 20.

The central zone 35 has a second thickness S2 which is not zero lower than the first thickness S1.

In practice, the central zone 35 defines a separating wall or a layer with reduced thickness of the separator element 30.

For example, this separating wall (or layer) with reduced thickness of the separator element 30 can be centered on the median plane of the separator element 30 or be disposed off-centre with respect thereto, or proximal to one of the two faces 310 of the main zone with respect to the other.

The central zone 35 is at least partially (for example at least on two or three sides) delimited on the perimeter by the main zone 31 and is joined to it by a step 350 (in which the thickness of the separator element 30, at the step, increases abruptly from the second thickness S2 to the first thickness S1, for example by defining a raised surface perpendicular to the face 31) or a ramp (for example gradual, in which the thickness of the separator element 30, at the ramp, gradually increases from the second thickness S2 to the first thickness S1 or variously shaped).

The central zone 35, for example, defines two (flat) facades substantially parallel to the faces 310, in which each facade is joined to a respective face 310 by means of a respective step 350 (defined for example by a surface perpendicular to the respective face 310) or from a respective ramp.

As mentioned above, in the case in which the separating wall defining the central zone 35 is centered on the median plane of the separator element 30, so the facades of the central zone 35 are equidistant from the respective faces 310 of the main zone, in the case in which, on the other hand, the separating wall that defines the central zone 35 is disposed off-centre with respect to the median plane of the separator element 30, then the facades of the central zone 35 are placed at different distances from the respective faces 310 of the main zone 31.

The central zone 35, for example, is joined below to the (upper surface 22 of the) base 20, which—therefore—delimits on the perimeter, together with the main zone 31, the central zone itself.

The second thickness S2 of the central zone 35 defines the minimum thickness of the entire separator element 30.

For example, the second thickness S2 is lower than 0.3 mm, preferably lower than or equal to 0.1 mm.

The central zone 35 (i.e. each facade thereof) has an overall polygonal shape, for example quadrangular or trapezoidal or triangular, with a lower base joined to the (upper surface 22 of the) base 20 and the remaining sides delimited by the aforementioned step 350 or by the aforementioned ramp.

For example, the main zone 31 comprises two (side) legs which are joined (below) to the base 20 (and which define part of the lower end 32 of the separator element 30) and which laterally delimit the central zone 35 by means of a respective side portion of the step 350 or of the ramp.

Furthermore, (in the example, the main zone 31 comprises a crosspiece joined (superiorly) to the top of the legs, at a non-zero distance (from the defined resting plane Q) from the upper surface 22 of the base 20, which superiorly delimits the central zone 35 by means of a respective upper portion of the step 350 or of the ramp.

The crosspiece extends longitudinally in a direction parallel to the resting plane Q and perpendicular to the tiling direction A.

In the example, the central zone 35 has a predetermined height, defined by the (maximum) distance between the upper portion of the step 350 or the ramp (or the top of the legs) and the resting plane Q of the upper surface 22 of the base 20.

Furthermore, the central zone 35 has a predetermined width, defined by the reciprocal (maximum) distance between the side portions of the step 350 or of the ramp.

Preferably, the base is made as a single body, that is, the separator element 30 is made as a single (monolithic) body with the base 20, for example obtained by plastic moulding together with the base itself.

Furthermore, the separator element 30 has a predetermined fracture line or section 34 adapted, in use, to be arranged below the level of the visible surface of the tiles P to be spaced and leveled, for example substantially at the same level (of the resting plane Q) as the upper surface 22 of the base 20 or, as in the example, a little higher.

For example, the predetermined fracture line or section 34 is made on the separator element 30 near the base 20, for example slightly above the level defined (by the resting plane Q) by the upper surface 22.

It is not excluded that the predetermined fracture line or section 34 can be made at the junction line between the base 20 and the separator element 30.

In practice, the separator element 30, that is the lower end 32 thereof, is joined to the base 20 by means of such a predetermined fracture line or section 34, which for example defines a fracture line substantially parallel (to the resting plane Q) to the upper surface 22 of the base 20 itself.

Thanks to this predetermined fracture line or section 34, the whole emerging portion (from the tiles P) of the device 10, comprising the separator element 30, can be easily removed once the tiles P are installed and the adhesive supporting them has consolidated, while the portion immersed in the adhesive, that is the base 20 (and a small foot portion of the separator element 30), remains trapped (disposable) in the adhesive itself below the application surface of the levelled tiles P.

The predetermined fracture line or section 34 develops longitudinally in a direction parallel to the upper surface 22 (and to the central plane) along the entire width of the separator element 30, whereby width means the direction perpendicular to the tiling direction A and parallel to (the resting plane Q defined by) the upper surface 22 of base 20.

For example, the predetermined fracture line or section 34 has two side stretches (highlighted in FIG. 26 with the number 341), which are configured to intersect (and cross) the main zone 31 of the separator element 30, in particular each side stretch 341 intersects (and crosses) a respective leg of the main zone 31.

For example, the side stretches 341 of the predetermined fracture line or section 34 comprise, for example, a longitudinal cut developing longitudinally with a longitudinal axis parallel to the direction perpendicular to the tiling direction A and parallel to (the resting plane defined by) the surface top 22 of base 20.

The longitudinal cut extends for a predetermined stretch of the width of the separator element 30, preferably for the entire width of a leg of the main zone 31.

Preferably, each longitudinal cut defines a (weakened) zone having a reduced cross section, having a third thickness S3 smaller than the first thickness S1, on which the fracture of the main zone 31 of the separator element 30 with respect to the base 20 preferentially develops.

Each predetermined fracture line or section 34 can also comprise at least one fracture initiation element, which is located in a predetermined initiation zone of the longitudinal cut along its longitudinal axis.

The initiation element defines the initiation zone of the longitudinal cut having a reduced thickness.

This reduced thickness (localized at the initiation element) can be comprised between the zero thickness (comprised) and the thickness of the (weakened) zone of the longitudinal cut (not comprised).

Advantageously, the initiation element is localized close to at least one axial end of the longitudinal cut.

Preferably, but not limited to, the initiation element is localized close to at least one axial end of the longitudinal cut at a predetermined non-zero distance therefrom.

The initiation element comprises or consists of a initiation hole passing from side to side for the entire thickness of the separator element 30, in which the through axis of the hole is transverse (and incident), preferably perpendicular with respect to the longitudinal axis of the longitudinal cut, i.e. it is parallel to the tiling direction A.

The initiation hole is for example with a constant circular section, that is it has a substantially cylindrical shape, however it is not excluded that this hole may have different shapes according to requirements.

Each side stretch 341 of the predetermined fracture line or section 34 comprises a respective (single) initiation element placed close to one (only) axial end of the respective longitudinal cut, preferably the external axial end (distal from the central zone 35 of the separator element 30).

The central zone 35 of the separator element 30 preferably intersects the predetermined fracture line or section 34, interrupting it and dividing it into the two side stretches described above (in which each stretch of the predetermined fracture line or section 34 is placed alongside the central zone 35 (in the direction perpendicular to the tiling direction A and parallel to the resting plane Q).

The second thickness S2 of the central zone 35 is preferably smaller (or at most equal) to the third thickness S3 (or to the reduced thickness).

In practice, the central zone 35 (as a whole) defines a central stretch (numbered only in FIG. 26 with the number 342) of the predetermined fracture line or section 34 which joins the two side stretches 341.

The central zone 35 actually defines a propagation zone (free or substantially free) of the fracture along the predetermined fracture line or section 34 which propagates starting from one (or both) of the side stretches thereof.

The predetermined fracture line or section 34 in the central zone 35 has a substantially curved longitudinal development with concavity turned towards the base 20, for example similar or equal to the overall shape of the step 350 (i.e. having two side portions that are salient with respect to the base and, for example for example, a central portion substantially parallel to the resting plane Q) or of the ramp.

In a variant of the device 10, shown in FIGS. 21-25, the central zone 35 comprises at least one fracture guide element 340.

The guide element 340 is, for example, localized in a predetermined guide position and/or change of direction of the fracture along its prevailing direction of development in the central zone 35.

The guide element 340 defines the weakened zone of the central zone 35 having a reduced thickness.

This reduced thickness (localized at the guide element 340) can be comprised between the zero thickness (comprised) and the thickness of the weakened zone of the longitudinal cut (not comprised).

Advantageously, the guide element 340 is positioned at a height (with respect to the resting plane Q of the upper surface 22) greater than or equal to the height at which (each of) the initiation elements is located.

The guide element 340 comprises or consists of a guide hole passing from side to side for the entire thickness of the central zone 35 of the separator element 30, in which the through axis of the guide hole is transverse (and incident), preferably perpendicular with respect to the longitudinal axis of the longitudinal cut, i.e. it is parallel to the tiling direction A.

The guide hole is for example with a constant circular section, that is it has a substantially cylindrical shape, however it is not excluded that this hole may have different shapes according to requirements.

Preferably, the central zone 35 has a plurality (for example 4 in number) of laterally spaced guide holes.

In the example, the central zone 35 comprises two (or one) upper guide holes, i.e. placed at a height greater than the height of the initiation holes, for example in which each of them defines an upper virtual vertex of the central stretch of the predetermined fracture line or section 34 (i.e. a virtual vertex which joins a salient side portion to the central portion thereof).

Furthermore, the central zone 35 comprises two lower guide holes, i.e. placed at an equal height as the height of the initiation holes, for example in which each of them defines a lower virtual vertex of the central stretch of the predetermined fracture line or section 34 (i.e. a virtual vertex which joins a salient side portion to one of the side stretches of the predetermined fracture line or section 34 affecting the main zone 31, i.e. the leg thereof).

The device 10, i.e. the base of the same, further comprises a corner spacer 25, which is configured to come into contact with side edges P3 perpendicular to the facing side edges P3 of the tiles P, for the alignment of the tiles P along a direction D perpendicular to the tiling direction A and parallel to the resting plane Q defined by the upper surface 22 of the base 20.

In the example, the corner spacer 25 rises (at the top, i.e. on the same side as the separator element 30) from the upper surface 22 of the base 20 in direct contact therewith), for example along a direction perpendicular to the resting plane Q defined by upper surface 22 thereof.

Preferably, the corner spacer 25 is placed in a central band of the base 20, i.e. lying on a median plane of the base 20 perpendicular to the median plane on which the separator element 30 lies.

The corner spacer 25, therefore, is defined by a parallelepiped block, which has a base end constrained to (and made as a single body with) the base 20, that is defined at the upper surface 22 thereof, an opposite top free end 250, for example parallel to the upper surface 22 of the base 20 and at a (non-zero) distance therefrom.

The corner spacer 25, i.e. the parallelepiped block, is elongated along its own longitudinal axis, which is parallel to the tiling direction A, that is, it is perpendicular to the faces 310 of the separator element 30.

The corner spacer 25 is centered on the base 20, i.e. its median longitudinal plane coincides with the median plane of the base 20 parallel to the tiling direction A and perpendicular to the resting plane defined by the upper surface 22 of the base itself.

The corner spacer 25, i.e. the parallelepiped block, comprises at least two opposite planar and parallel (to each other) side edges 251, which are configured to come into contact with the edges of two tiles P to be placed side by side along said direction D.

The mutual distance between the side edges 251 of the corner spacer 25 defines the thickness of the corner spacer 25 (in a direction parallel to the tiling direction A and to the upper surface 22) and, therefore, the width of the joint between the tiles P separated therefrom.

Each of the side edges 251 is perpendicular to the resting plane Q defined by the upper surface 22 of the base 20 and, moreover, is square-angled with respect to the faces 310 of the separator element 30.

The side edges 251 are longitudinal, that is, parallel to the longitudinal axis A of the corner spacer 25, for example with full development of the same.

Advantageously, the thickness of the corner spacer 25, which is preferably constant for the entire longitudinal development of the corner spacer 25, is substantially equal to the first thickness S1 of the main zone 31 of the separator element 30, so that the tiles P are spaced both along the direction D and along the perpendicular tiling direction A by the same distance.

However, it is not excluded that the thickness of the corner spacer 25 is different from the thickness of the separator element 30 according to the different applications needs of the tiles P.

The corner spacer 25 is aligned along the tiling direction A to the central zone 35 of the separator element 30.

The corner spacer 25 has two opposite axial ends 252, which are defined by two opposite smaller faces, for example, perpendicular to the side edges 251 and to the top end 250.

In practice, the corner spacer 25 has an external axial end 252, distal from the separator element 30, and an internal opposite axial end 252, proximal to and in contact with (at least one zone of) the separator element 30.

More in detail, the internal axial end 252 of the corner spacer 25 is joined to (and in contact with) the central zone 35 of the separator element 30, or with a face thereof.

The internal axial end 252 of the corner spacer 25 is, in fact, circumscribed (at least on three sides) inside the step 350 or the ramp, at a non-zero distance therefrom.

The external axial end 252 is, for example, substantially flush with one end of the base 20 (distal from the separator element 30).

The height of the central zone 35, from the resting plane Q defined by the upper surface 22 of the base 20, is greater than the height of the corner spacer 25, i.e. the (maximum) distance between the top end 250 and the resting plane Q defined by the upper surface 22 of the base 20.

Moreover, the width of the central zone 35 is greater (or at most equal) to the (maximum) thickness of the corner element 25, intended as the distance between the side edges 251 of the same.

Furthermore, as can be seen in FIG. 26, the two side stretches 341 of the predetermined fracture line or section 34 have a maximum height a1 lower than a maximum height a2 of the top end 250 of the corner spacer 25 with respect to the resting surface Q.

The central stretch 342 of the predetermined fracture line or section 34 propagates/develops (freely and/or guided) along the central zone 35, for example it propagates/develops along a propagation line (curved or broken and concave with concavity turned towards the base 20) which has a maximum height a3 greater than the maximum height a2 of the top end 250 of the corner spacer 25 with respect to the resting surface Q (even if contained within the central zone 35 itself).

Therefore, the predetermined fracture line or section 34 globally has a substantially longitudinal development of a broken line, formed by the two side stretches 341 (substantially straight) and the central stretch 342 (arched) which rises above the top end 250 of the corner spacer 25.

In a first embodiment, shown in detail in FIGS. 1-15 and 21-24, the device 10 has two corner spacers 25 as described above, arranged on opposite sides with respect to the separator element 30, in which each corner spacer has a respective internal axial end 252 in contact with and joined to a respective facade of the central zone 35, i.e. in which each corner spacer 25 derives from a respective facade of the central zone 35.

In this first embodiment, the base, which globally has a conformation in which the separator element 30 and the corner spacer 25 are substantially crossed in an "X" shape is intended to be positioned in support of four tiles P, at an edge of the same.

In this case, the side edges 251 of the two corner spacers 25 are two by two substantially coplanar and perpendicular to the side edges 310 of the separator element 30, so as to guarantee the effective alignment of the side edges P3 of the tiles P along the direction D.

In a second embodiment, shown in detail in FIGS. 16-20 and 25, the device 10 has a single corner spacer 25 as described above, that is to say that it derives from a single facade of the central zone 35.

In this second embodiment, the base, which globally has a conformation in which the separator element 30 and the corner spacer 25 are substantially arranged in an "T" shape is intended to be positioned in support of three tiles P, at an edge of the same.

The device 10, that is the base of the same, then comprises a threaded stem 40, for example provided with a male thread 41, which rises perpendicularly (to the defined resting plane Q) from the upper surface 22 of the base 20, preferably from the free end 33 of the separator element 30, axially extending the same.

In practice, the screwing axis, indicated by the letter B in the figures, is perpendicular to the resting plane Q defined by the upper surface 22 of the base 20.

The male thread 41 extends, for example, substantially over the entire length of the threaded stem 40 and, for example, has a constant pitch.

The threaded stem 40 in the example has a substantially double length with respect to the height of the separator element 30.

Preferably, the threaded stem 40 is made in a single (monolithic) body with (the base, or with) the separator element 30 (and the base 20), or for example obtained by plastic moulding together with the base itself.

The device 10 then comprises a pressing element 50 (defined by a separated body with respect to the base), which is adapted to be screwed onto the threaded stem 40 of the base.

The pressing element 50 comprises a knob 51 having a globally inverted cup or bowl shape, that is a concave shape (with concavity turned towards the base 20 in operation).

The knob 51 develops, for example, around a central axis C, adapted to be placed coaxial with the threaded stem 40 when the pressing element 50 is screwed onto it, as will be better described below.

The knob 51 has, in the example, a substantially truncated-conical or dome shape, that is, it has an enlarged (lower) end and an opposite tapered top end.

It is not excluded that the knob 51 may have any other shape, such as for example cylindrical, like a butterfly, a handle, or other suitable shape suitable for being gripped by a hand of a person in charge of the installation for screwing it.

In the example, the enlarged (lower) end of the knob 51 defines an inlet mouth or cavity 510, for example substantially circular (coaxial with the central axis C of the knob itself).

The inlet cavity 510 has, for example, an inner diameter greater than the outer diameter of the male thread 41 of the threaded stem 40, so that the latter can be slotted axially with abundant radial clearance inside the inlet cavity 510 of the knob 51.

More preferably, the inlet cavity 510 has an inner diameter substantially equal to or slightly greater than the width (maximum length) of the separator element 30, so that the latter can be slotted axially with radial clearance inside the inlet cavity 510 of the knob 51 itself, when the pressing element 50 is screwed onto the threaded stem 40.

In the shown example, the knob 51 comprises a substantially smooth inner shell and a shaped outer shell.

The outer shell of the knob 51, for example, comprises protrusions 511 (or ridges), for example in number of 4, to facilitate the grip and the rotation actuation for screwing the knob itself.

Each protrusion 511 has, for example, a substantially triangular shape, preferably with a side perpendicular to the inlet cavity 510 of the knob 51.

Furthermore, the knob 51 can have one or more windows 512, for example through or transparent windows, made at the wall which joins the enlarged (lower) end of the knob 51 with its tapered top.

For example, each window 512 is made at an interspace (or recess) between two adjacent protrusions 511.

Each window 512, in the example, passes in a continuous way from the outer shell to the inner shell and forming a decreasing and connected ramp and, preferably, has a substantially ogival (rounded and elongated) shape, enlarged towards the (lower) enlarged end of the knob 51.

The knob 51 also has a planar end 513 adapted to be turned towards the base 20 (parallel thereto) when the pressing element 50 is screwed onto the threaded stem 40 and perpendicular to the central axis C of the knob 51.

The planar end 513 actually delimits (with full development) the inlet cavity 510 of the knob 51.

The planar end 513 is for example substantially shaped like a circular crown, preferably defined by the base of a cylindrical shank coaxial with the central axis C and deriving inferiorly from the cap (trunco-conical) portion of the knob 51.

In the example, the planar end 513 is defined by a pair of concentric circular crowns, for example each defined by the base of a cylindrical shank coaxial with the central axis C, as described above.

In practice, the planar end 513 is adapted to be turned, in use, towards the base 20 (or towards the tiles P resting on the base 20) and defines a perfectly planar annular surface perpendicular to the central axis C of the knob 51.

The knob 51 comprises, for example at or near the planar end 513, an annular step 514 projecting radially towards the outside of the knob itself, for example of the outer shell thereof and (also) of the protrusions 511.

The annular step 514, for example, has a substantially circular shape (at least its outer perimeter) and is coaxial with the central axis C (and with the inlet cavity 510).

The annular step 514 therefore defines a cylindrical (external) surface concentric with the central axis C of the knob 51.

Furthermore, the annular step 514 defines a lower annular surface concentric with the central axis C of the knob 51, and for example perpendicular thereto, and an opposite upper annular surface, for example it being also planar and parallel to the planar end 513 (and arranged at a higher level, that is closer to the top of the knob 51).

The pressing element 50 particularly comprises a spindle nut 515 (female thread) configured to couple (with a helical coupling) with the male thread 41 of the threaded stem 40.

The spindle nut 515 has, for example, a screwing axis coinciding with the central axis C of the knob 51.

The spindle nut 515 is, for example, made at (or near) the tapered top of the knob 51

For example, the spindle nut 515 is defined at an upper shank 516 which rises up from the top of the knob 51, for example having a substantially trunco-conical (or cylindrical or prismatic) shape.

The spindle nut 515 passes axially from side to side said upper shank 516 and, for example, at its internal end (i.e. the one that opens up into the internal shell of the knob 51) is equipped with a lead-in taper to facilitate the axial insertion and alignment of the threaded stem 41 with the spindle nut 515.

The spindle nut 515 is, advantageously, defined by a continuous helix, preferably of a plurality of turns.

The pressing element 50 in the example shown is defined, as a whole, by a monolithic body, for example made of a plastic material (obtained by injection moulding).

The device 10 can further comprise a protection ring nut 60 (made in a body separate from the pressing element and the base), which is adapted to be axially interposed—in operation—between the base 20 and the pressing element 50, that is between the pressing element 50 and the visible surface P2 of the tiles P resting on the base 20.

In detail, the pressing element 50 is rotatable (during its screwing rotation around the screwing axis B), in operation, with respect to the protection ring nut 60, which is held stationary (as will better appear below) with respect to the visible surface P2 of the tiles P.

The protection ring nut 60, in this case, comprises a slab-like body 61, for example with a thin thickness, preferably with an annular shape (or with any shape depending on the needs) provided with an upper face (turned towards the pressing element 50, when in use) and an opposite lower face (turned towards the base 20, when in use).

The protection ring nut 60, that is the slab-like body 61 of the same, comprises—at the upper face thereof—a first (upper) surface 610 intended to be turned towards the pressing element 50, when in use, and—at the lower face thereof—an opposite second (lower) surface 611, which is intended to be turned towards the base 20 (i.e. facing on the upper surface 22 of the base itself), when in use (i.e. when the protection ring nut 60 is axially interposed between the base 20 and the pressing element 50 themselves).

More particularly, the second surface 611 of the protection ring nut 60 is intended to be turned towards the surface in view P2 of the tiles P placed side by side and resting on the upper surface 22 of the base 20 and is configured to come into contact with the surface in view P2 of the tiles P themselves.

The first surface 610 and the second surface 611 are, for example, singularly planar and substantially parallel to each other; preferably the first surface 610 and the second surface 611, in use, are substantially perpendicular to the screwing axis B of the spindle nut 515 on the threaded stem 40.

For example, the first surface 610 is substantially annular with a circular shape.

The first surface 610 is adapted to come into contact (sliding, for example along a circular sliding trajectory) with the planar surface 513 of the pressing element 50, during the screwing rotation of the pressing element 50 on the threaded stem 40.

In the example, the protection ring nut 60 has a first surface 610 for each planar surface 513 provided in the pressing element 50.

The first (planar) surface 610 could affect (occupy) the entire area of the upper (annular) face of the protection ring nut 60 or only a portion (annular or annular in some stretches) of the same.

The protection ring nut 60 could provide one or more centering protrusions or grooves 612 placed at the upper face (surrounding the first surface 610, for example concentric thereto), for example with an annular shape or in any case adapted to define an annular track, which can be engaged by the pressing element 50, for example to guide their mutual rotation.

For example, the second surface 611 can be substantially annular, for example with circular (or any) shape.

Alternatively, the second surface 611 can be defined by a plurality of portions of discrete planar (distinct from each other) and coplanar surfaces and/or portions of discrete point (distinct from each other) and coplanar surfaces which together form a planar surface.

The second surface 611 is adapted to come into contact (substantially by adhesion) with the visible surface P2 of the tiles P resting on the (upper surface 22 of the) base 20 (and to remain substantially braked/adherent during the screwing rotation of the pressing element 50 on the threaded stem 40).

The second surface 611, in use, is adapted to come into contact with the surface in view P2 of the tiles P remaining substantially integral thereto (stationary, without sliding) during the screwing rotation of the pressing element 50 on the threaded stem 40.

The second (planar) surface 611 could affect (occupy) the entire area of the lower (annular) face of the protection ring nut 60 or only a portion (annular or annular in some stretches) of the same.

In practice, the second surface 611 of the protection ring nut 60 is defined by the portion of the lower face of the protection ring nut 60 more distal from the upper face of the protection ring nut itself, on which the protection ring nut 60 rests when it is resting on the lower face itself.

The protection ring nut 60 is configured so as to remain stationary resting on the visible surface P2 of the tiles P during the screwing rotation of the pressing element 50 on the threaded stem 40.

In the example shown, this effect is obtained by conforming the protection ring nut 60 so that the second surface 611 has a sliding (static or dynamic) friction coefficient greater than the sliding (static or dynamic respectively) friction coefficient of the first surface 610.

In other words, the protection ring nut 60 (i.e. the first surface 610 and the second surface 611 thereof)—and, for example, the pressing element 50 (i.e. the planar end 513 thereof) is configured so that the second surface 611 in contact with the visible surface P2 of the tiles P (whatever they are) has a sliding friction coefficient greater than the sliding (static or dynamic respectively) friction coefficient of the first surface 610 in contact with the planar end 513 of the pressing element 50.

In other words, the second surface 611 and the first surface 610 when they are in contact with an identical (reference) surface, for example with the planar end 513, generate with said (reference) surface a different sliding friction coefficient (i.e. a friction-resistant force) and in particular, the second surface 611 in contact with said (reference) surface generates therewith a sliding friction coefficient (i.e. a friction-resistant force) greater than the first surface 610 when in contact with the same (reference) surface.

In practice, the second surface 611 and the first surface 610 with the same conditions of contact with an identical (reference) surface, which could be defined by the planar end 513), generate therewith a different friction-resistant force, such that the friction-resistant force exerted by the second surface 611 is greater than the friction-resistant force exerted by the first surface 610.

That is, the second surface 611 is configured so as to exert a binding sliding reaction (in opposition to a twisting moment which would cause it to rotate around an axis perpendicular to the second surface itself) on the visible surface P2 of the tiles P (whatever they are) greater (in the modulus) than a binding sliding reaction (in opposition to a twisting moment which would cause it to rotate around an axis perpendicular to the second surface itself) that the first surface 610 exerts on the planar end 513 of the pressing element 50.

It is not excluded that the second surface 611 may be adhesive, for example by means of glue (of the stick-and-peel type) or by a suction cup effect or the like.

In a preferred embodiment, the first surface 610 is made of a (plastic) material different from the (plastic) material of which the second surface 611 is made.

Preferably, the first surface 610 is made of a first substantially rigid (non-deformable) material, for example it is made of plastic (or at most of metal).

Advantageously, the second surface 611 is made of a second resilient and/or adhesive and/or yielding material, for example it is made of an elastomeric material, such as for example rubber (preferably rigid rubber) or silicone or another similar material.

In this case, the protection ring nut 60 could advantageously be obtained as a single body by co-moulding plastic materials.

For example, the protection ring nut 60 could be obtained by joining (indissolubly and stably) a first bearing body (made of the first aforesaid material), which also defines—among other things—the first surface 610, and one or more second functional bodies (made of the aforesaid second material), which defines the second surface 611.

For example, the second surface 611 could be defined by the lower surface of one or more second functional bodies (having a defined thickness), with an annular or any shape, which have an upper surface (opposite to the lower surface) in direct contact with stable adhesion to a surface portion of the interface of the first bearing body of the protection ring nut 60 (at the lower face of the protection ring nut 60 itself).

Figure 3:
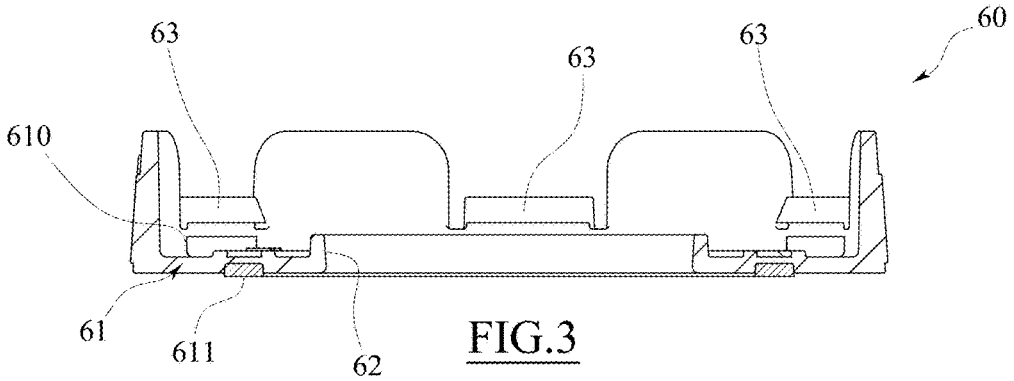
FIG. 3 is a sectional view along the trace of section III-III of FIG. 2.
Figure 4:
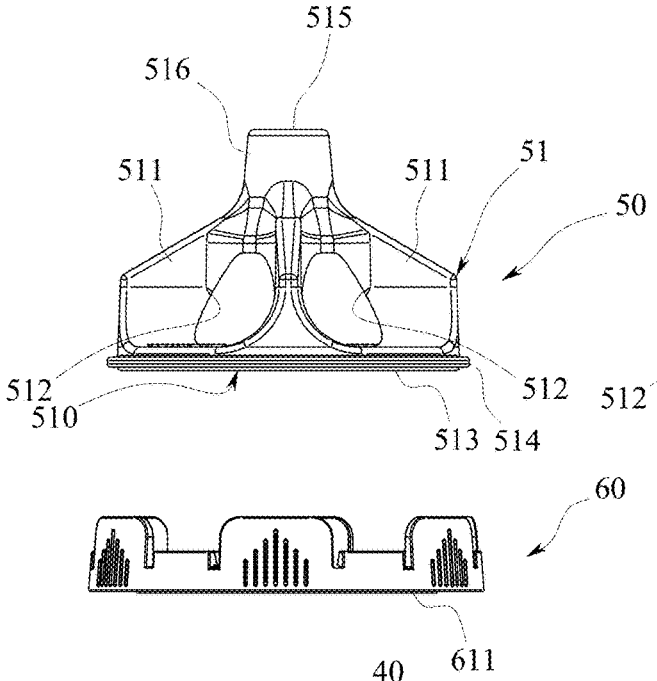
FIG. 4 is a raised side view of FIG. 1.
Figure 4:
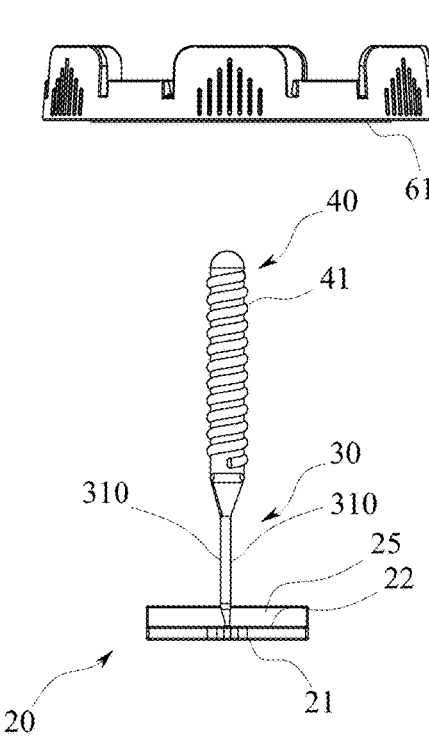
Figure 5:
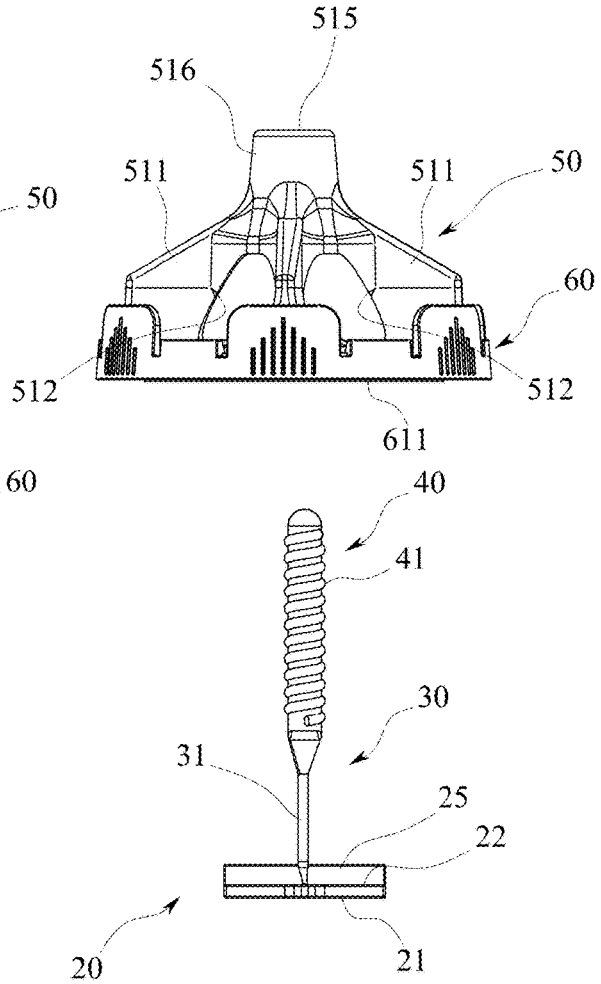
FIG. 5 is a view of the levelling spacer device of FIG. 1 with the protection ring nut constrained to the pressing element.
Figure 6:
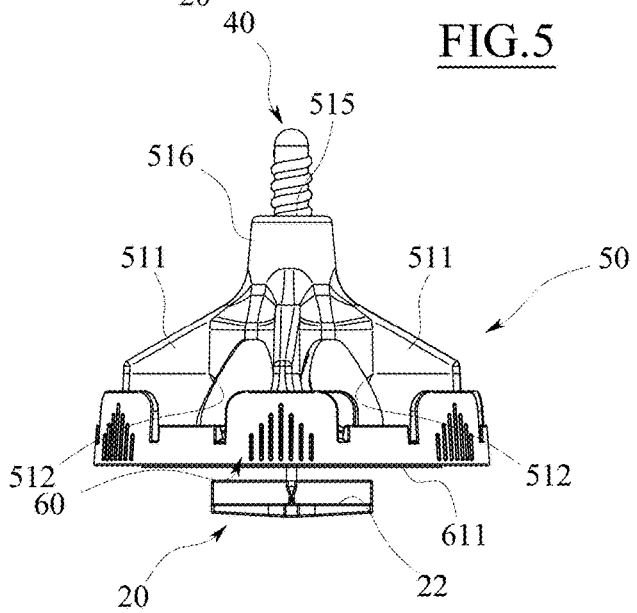
FIG. 6 is a view of the levelling spacer device of FIG. 5 with the pressing element screwed onto the threaded stem.
Figure 11:
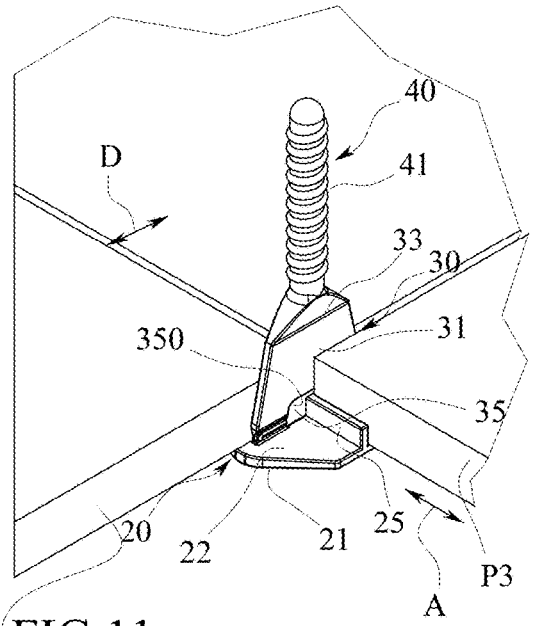
FIG. 11 is an axonometric view of the base of FIG. 7 in an operative configuration.
Figure 12:
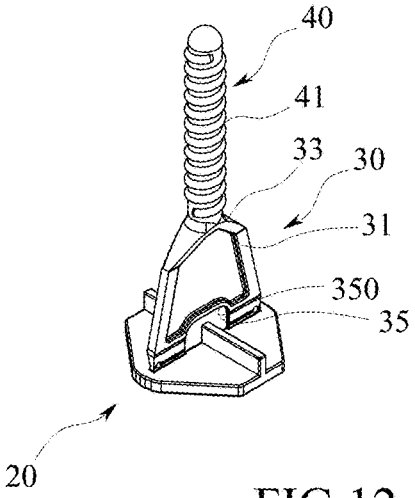
FIG. 12 is an axonometric view of a base according to a first embodiment (in which the main zone has a first determined thickness which is increased with respect to the base of FIG. 7).
Figure 13:
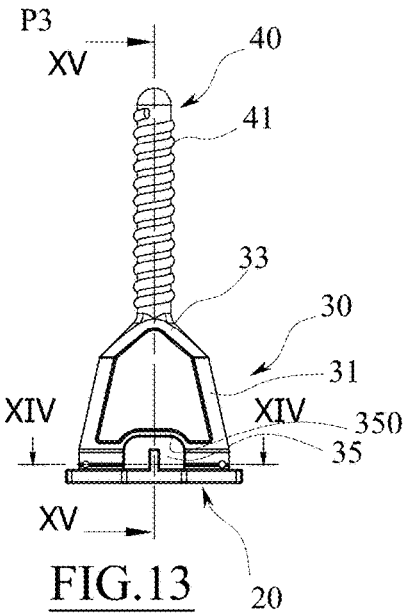
FIG. 13 is a front view of FIG. 12.
Figure 15:
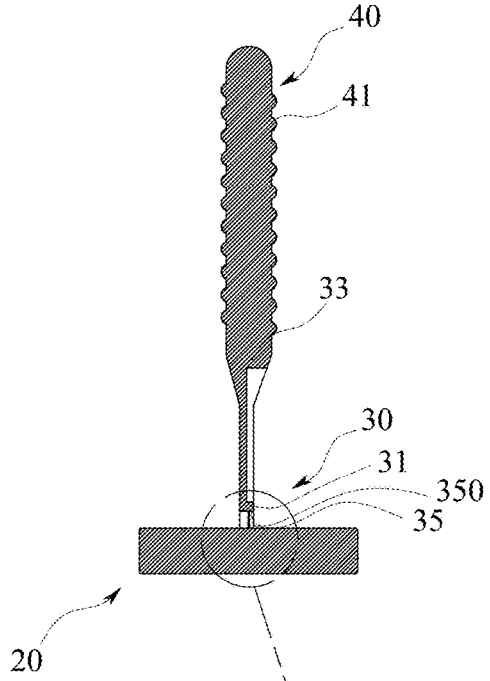
FIG. 15 is a sectional view along the section plane XV-XV of FIG. 13.
Figure 14:
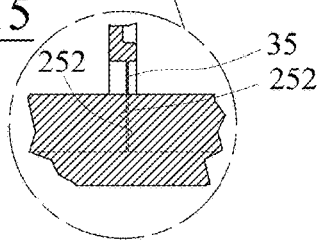
FIG. 14 is a sectional view along the section plane XIV-XIV of FIG. 13.
Figure 14:
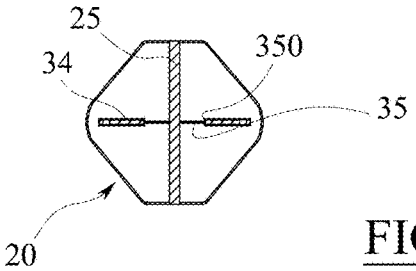
Figure 16:
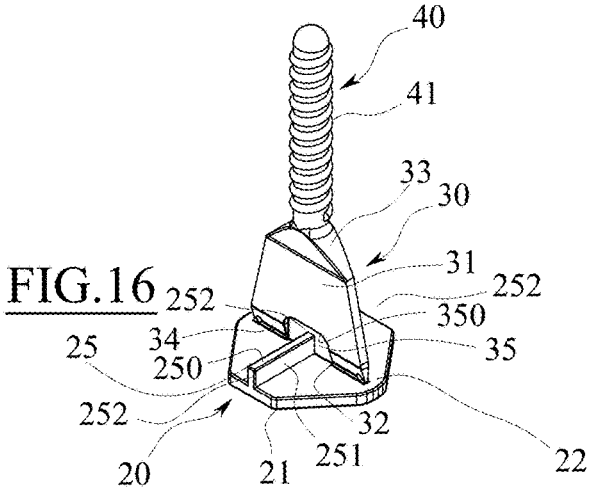
FIG. 16 is an axonometric view of a base according to a second embodiment (in which the main zone has a first determined thickness).
Figure 17:
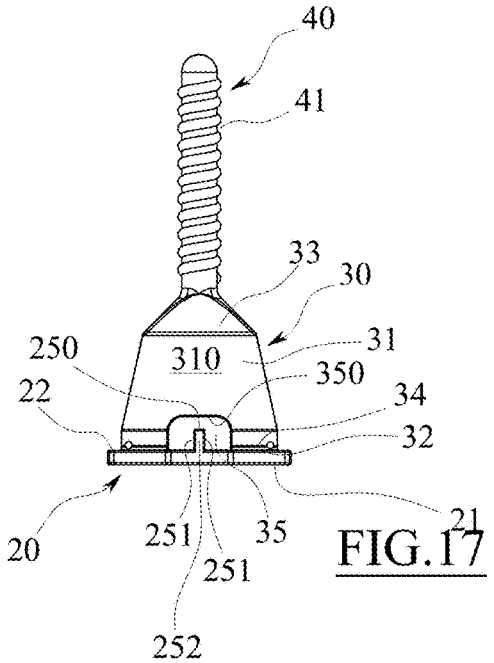
FIG. 17 is a front view of FIG. 16.
Figure 18:
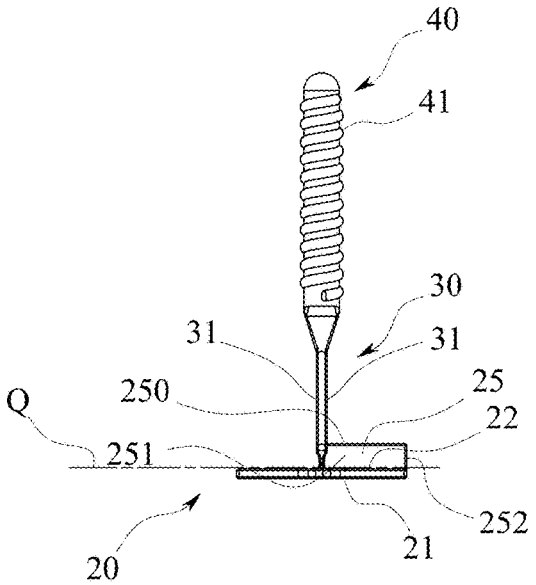
FIG. 18 is a side view of FIG. 16.
Figure 19:
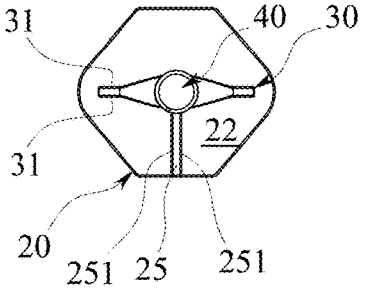
FIG. 19 is a plan view from above of FIG. 16.
Figure 25:
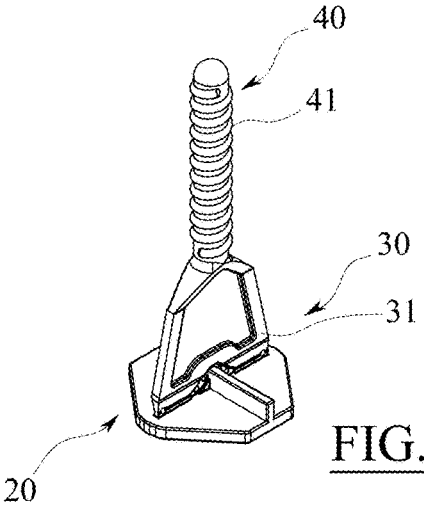
FIG. 25 is an axonometric view of a base according to a variant of the second embodiment (in which the main zone has a first determined thickness which is increased with respect to the base of FIG. 7).
Figure 20:
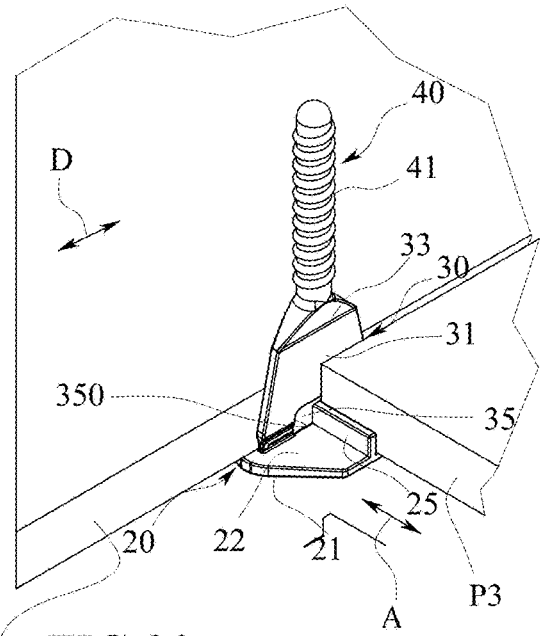
FIG. 20 is an axonometric view of the base of FIG. 16 in an operative configuration.
Figure 21:
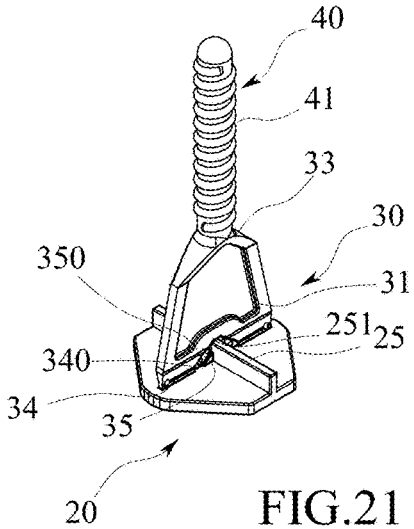
FIG. 21 is an axonometric view of a base according to a variant of the first embodiment (in which the main zone has a first determined thickness which is increased with respect to the base of FIG. 7).
Figure 22:
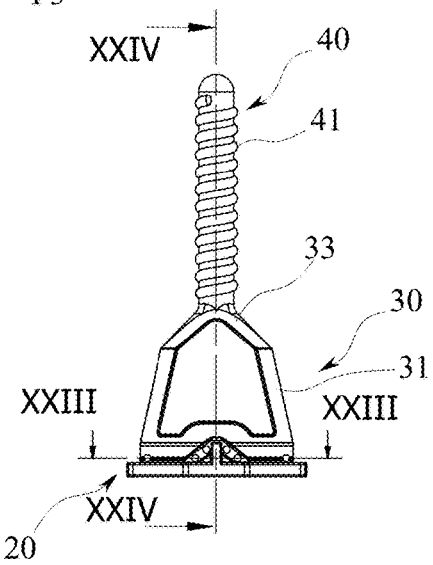
FIG. 22 is a front view of FIG. 21.
Figure 24:
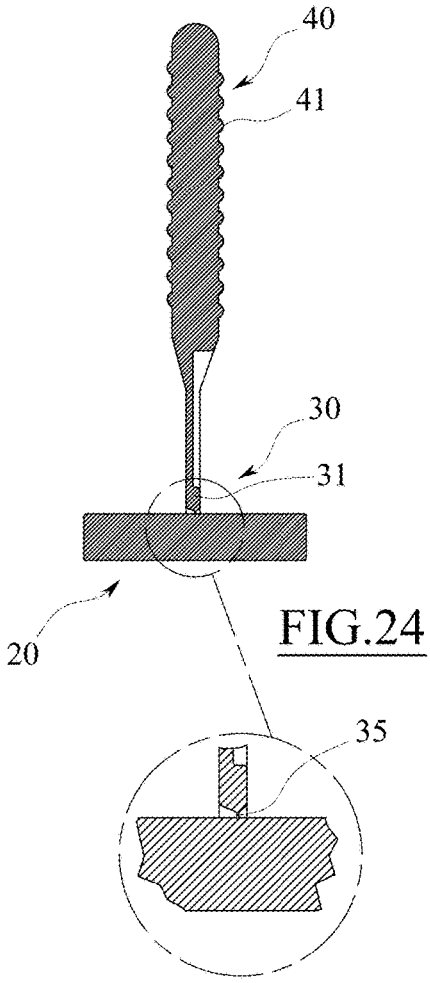
FIG. 24 is a sectional view along the section plane XXIV-XXIV of FIG. 22.
Figure 23:
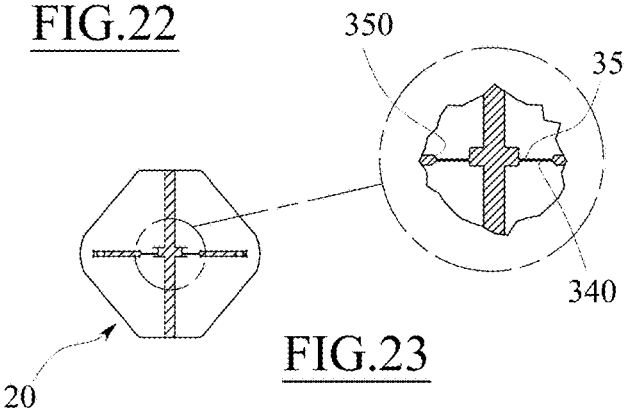
FIG. 23 is a sectional view along the section plane XXIII-XXIII of FIG. 22.
Figure 27A:
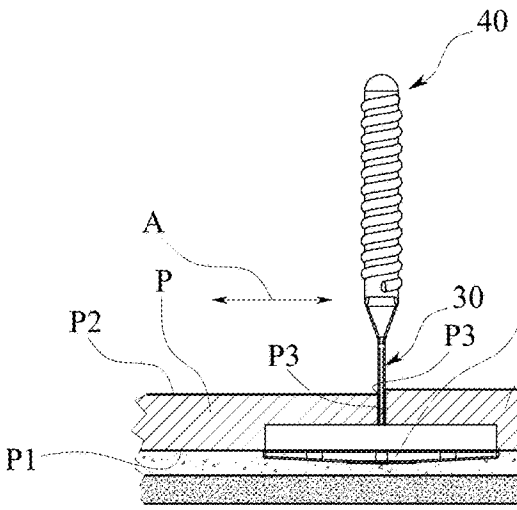
FIGS. 27*a*-27*d* are an operating sequence of the levelling spacer device according to the invention.
Figure 27B:
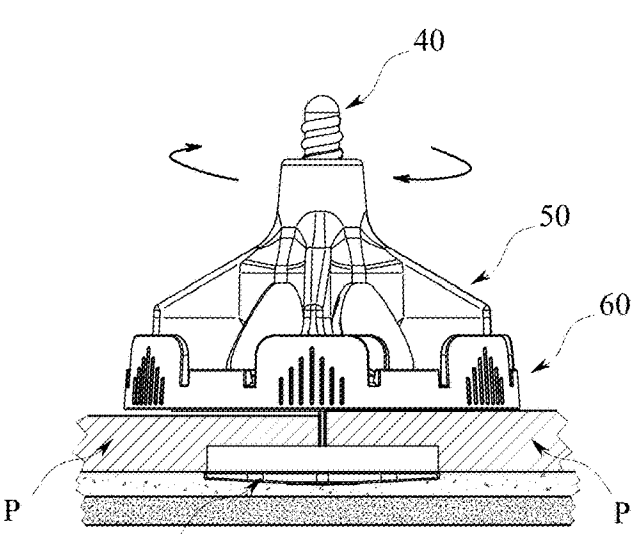
Figure 27C:
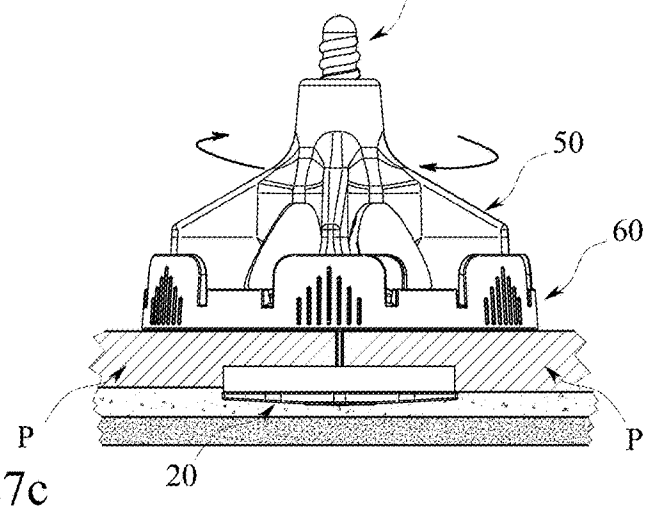
Figure 27D:
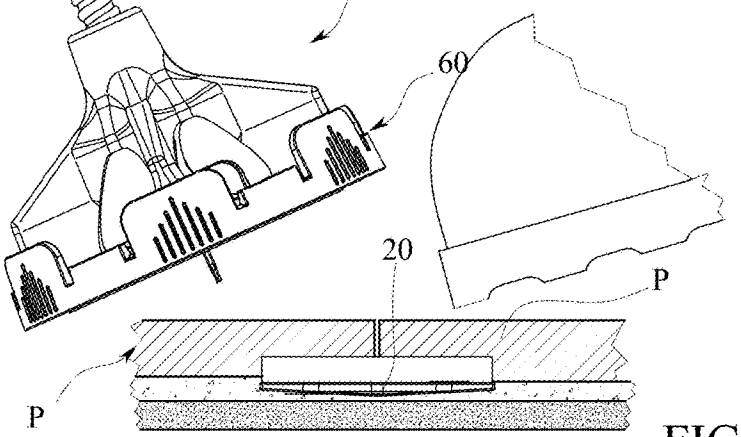

For example, a concave seat, for example an annular seat, (with concavity facing downwards) can be defined in the first bearing body of the protection ring nut 60, at the lower face thereof within which seat a portion of root of the first functional body is received (and firmly adhered), which rises up axially from the concave seat so as to make the second surface 611 defined by it rise up with respect thereto (see FIG. 3).

It is not excluded that the second functional bodies are made of a plurality of feet, for example with a hemispherical or prismatic shape or any other shape which define, on the whole, a (single) resting plane such as to constitute the second surface 611.

Yet, it is not excluded that the second functional body of the protection ring nut 60 is defined by an annular body having an outer diameter substantially equal to the outer diameter of the first bearing body and an inner diameter for example substantially equal to an inner diameter of the first bearing body itself, wherein also the first bearing body is substantially annular in shape.

In an alternative embodiment, it is possible to provide that the second surface 611 can be removably associated with the protection ring nut 60.

For example, the protection ring 60 could be obtained by joining releasably a first bearing body (made of the first aforesaid material), which also defines—among other things—the first surface 610, and one or more second functional bodies (made of the aforesaid second material), which defines the second surface 611.

For example, the second surface 611 could be defined by the lower surface of one or more second bodies (having a defined thickness), with an annular or any shape, which have an upper surface (opposite to the lower surface) fixed (for example in direct contact) to a surface portion of the interface of the first bearing body of the protection ring nut 60 (at the lower face of the protection ring nut 60 itself).

For example, a concave seat, for example an annular seat, (with concavity facing downwards) can be defined in the first bearing body of the protection ring nut 60, at the lower face thereof within which seat a portion of root of the first functional body is received—for example by interference or snap action—, which rises up axially from the concave seat so as to make the second surface 611 defined by it rise up with respect thereto.

For example, the second functional body could be made from a resilient ring of the type of an "O-ring".

It is not excluded that—also in this embodiment—the second functional bodies can be made of a plurality of feet associated snap-fittingly or in any case fixed in a removable way, to examples with a hemispherical or prismatic shape or any other shape that define, on the whole, a (single) resting plane such as to constitute the second surface 611.

Again, as an alternative to the above, it is possible to provide that the first surface 610 can be made of a plastic material equal to (or again different from) the plastic material of which the second surface 611 is made.

In this case, the difference between the sliding friction coefficient between the first surface 610 and the second surface 611 can be achieved by means of a different configuration of the surface roughness between the first surface 610 and the second surface 611 themselves.

In particular, the protection ring nut 60—which could be obtained as a single monolithic body by moulding a (single) plastic material—could be configured so that the second surface 611 has a surface roughness greater than the surface roughness of the first surface 610 intended to come into contact with the pressing element 50.

The protection ring nut 60 also comprises a through hole 62 (passing in an axial direction), for example central (i.e. coaxial with the first surface 610), which crosses the slab-like body 61 from side to side and is open at the upper face and the opposite lower face of the protection ring nut 60.

In a preferred embodiment shown in the figures, the through hole 62 has a circular shape with a (inner) diameter greater than the maximum width of the separator element 30, which can then be slotted (with its threaded stem 40) axially (with radial clearance) in the through hole 62 of the protection ring nut 60.

In an alternative embodiment, the through hole 62 can have any shape with a minimum diameter however greater than the maximum width of the separator element 30.

Furthermore, it is not excluded that an anti-rotation (prismatic) connection can be defined between the protection ring nut 60 (i.e. the through hole thereof 62) and the separator element 30 of the base.

Again, alternatively, the through hole 62 has an elongated shape like a slit with a longitudinal axis radial with respect to the central axis of the protection ring nut 60 and preferably, it crosses the centre of the protection ring nut 60. In practice, this through hole 62 shaped like a slit is centered on the axis of the protection ring nut 60.

In the example, said through hole 62 shaped like a slit is narrow and long, with a length slightly greater than the length of the separator element 30 and with a width slightly greater (for example less than 2 times) the first thickness S1 of the main zone 31 of the separator element 30.

Said through hole 62 shaped like a slit is therefore configured to slot (with clearance) on the separator element 30 (and cause a prismatic connection therewith).

In practice, the separator element 30 (on the part of its free end provided with the threaded stem 40) can be slotted axially inside the through hole 62 shaped like a slit and, once the separator element 30 is engaged inside said through hole 62 shaped like a slit, mutual rotation is prevented (except for small oscillations due to the tolerances involved and to the necessary clearance which allows the comfortable insertion of the separator element 30 into the slit 61) between the protection ring nut 60 and the separator element itself.

In this case, the through hole 62 shaped like a slit, for example, has substantially straight and parallel side edges between which the separator element 30 is substantially received to its size (with reduced side clearance).

Said through hole 62 shaped like a slit is sized in such a way that even the threaded stem 40 can be slotted axially (with abundant clearance) inside it.

Preferably, the protection ring nut 60 is rotatably associated with the pressing element 50, for example with respect to a rotation axis coinciding with the screwing axis of the spindle nut 51 of the pressing element itself.

The protection ring nut 60 is adapted to be associated with the planar end 513 of the pressing element 50, i.e. with the end of the same facing towards the base 20, so as to interpose between the base 20 and said planar end 513 (and, in use, between the visible surface of the tiles P and the planar end 503 itself) when the pressing element 50 is screwed onto the threaded stem 40.

Preferably, between the protection ring nut 60 and the pressing element 50, constraining means are defined which are adapted to axially constrain the protection ring nut 60 and the pressing element 50, allowing their (free) mutual rotation with respect to the rotation axis (coinciding with the screwing axis when the protection ring nut 60 is constrained to the pressing element 50).

The constraining means are, for example, a snap coupling configured to axially constrain, in a removable or semi-permanent way, the protection ring nut 60 and the pressing element 50 and leaving, as said, the mutual rotation between them free with respect to the mutual rotation axis.

In this case, the protection ring nut 60 comprises a plurality of coupling teeth 63 protruding, for example in the axial direction on the opposite side with respect to the second surface 611 and aligned along an imaginary circumference coaxial with respect to the protection ring nut 60 itself and, for example, having a diameter substantially greater than the outer diameter of the annular step 514 of the pressing element 50.

Each coupling tooth 63 has a leg rising up from the protection ring nut 60 (i.e. from its upper face), one end of which derives, for example in a single body therewith, from a peripheral portion of the protection ring nut itself and whose opposite free end comprises a coupling head substantially shaped like a spike turned towards the rotation axis E of the protection ring nut 60 and defining a coupling, substantially planar, surface, turned towards the upper face (i.e. the first surface 611) of the protection ring nut itself.

The coupling surface is distant from the upper face (i.e. the first surface 611) of the protection ring nut 60 by a height substantially equal to or slightly greater than the height of the annular step 514.

The coupling tooth 63, for example the leg thereof, is elastically yielding, preferably in radial direction, so that it can be snapped onto the pressing element 50, that is the annular step 514 thereof.

The coupling tooth, for example the leg thereof, has an arcuate shape (of a circular sector) in the direction of its circumferential width with a concavity turned towards the central axis of the protection ring nut 60.

The coupling head also defines a surface opposite to the coupling surface which can be inclined with respect to the first surface 610 by an acute lead-in angle, such as to impart a radial thrust (towards the outside of the protection ring nut 60) to the coupling tooth following an axial compression thrust on the coupling head of the coupling tooth itself.

In practice, the snap coupling between the pressing element 50 and the protection ring nut 60 is defined by the coupling between the coupling teeth and the annular step 514. The coupling teeth by widening apart radially, following a mutual axial approaching translation between the pressing element 50 and the protection ring nut 60, allow the annular step 514 to enter between the coupling teeth themselves, in practice bringing the planar end 513 of the pressing element 50 in (circumferential sliding) contact with the first surface of the protection ring nut 60, and possibly the coupling surface of the coupling teeth in (circumferential sliding) contact with the opposite upper annular surface of the annular step 514.

The legs of the coupling teeth, as a whole, can define a (in some stretches) cylindrical surface coaxial with the protection ring nut 60 and within which the perimetric edge of the annular step 514 rotates.

It is not excluded that the constraining means which mutually constrain the protection ring nut 60 and the pressing element 50 in an axial direction, leaving the mutual rotation free, may be different from those shown, for example of the interference type or other suitable connection, both semi-permanent and removable or, at most, permanent, depending on the construction needs.

Furthermore, it is possible to provide—in a more simplified embodiment—that said constraining means are not present. In this case, the protection ring nut 60 can be interposed from time to time between the pressing element 50 and the visible surface P2 of the tiles P, for example resting with the second surface 611 thereof on the visible surface P2 of the tiles P themselves. Even in this case, however, it is possible to provide that the protection ring nut 60 has centering protrusions or recesses 612 placed at the upper face (surrounding the first surface 610, for example in a concentric manner therewith), for example with an annular shape or in any case adapted to define an annular track, which can be engaged by the pressing element 50, for example to guide its mutual rotation, once the first surface 610 comes into contact with the planar end 513 of the pressing element 50.

In light of the above, the operation of the device 10 is as follows.

For covering a surface with a plurality of tiles P, it is sufficient to spread a layer of adhesive over it and, subsequently, it is possible to lay the tiles P.

In practice, in the location where the first tile P must be arranged, it is sufficient to position a first device 10, the base 20 of which is intended, for example, to be placed under one edge and two corners of three respective tiles P or four corners of four respective tiles P, depending on the desired installation pattern.

Once the base 20 has been positioned, it is sufficient to position the tiles P so that a portion of the side edge P3 is in contact respectively with one of the faces 310 of the separator element 30 and/or a portion of a further side edge P3 is in contact with one of the side edges 251 of the corner spacer 50.

In this way, the square-angled arrangement and the equidistance between the tiles P surrounding the device 10 is ensured. When, for example, the tiles P have particularly large dimensions and the arrangement of the tiles P allows it, then it is possible to position a device 10 also at a median zone of the side edge P3 of the tile itself.

It is not excluded that, for example, firstly a tile P is laid and then at the corner or a side edge P3 thereof, a base portion 20 of the device 10 is inserted under it.

Once the various bases 20 have been positioned with the respective separator elements 30 (and any corner spacers) as described above, as long as the adhesive has still not fully consolidated, however, it is proceeded by fitting and screwing a pressing element 50 into a respective threaded stem 40, so that the pressing element gradually descending towards the visible surface P2 of the tiles resting on the base 20 pushes on them, locally in the various (median or corner) points, allows the perfect levelling of the visible surfaces P2 of the tiles affected by the same device 10

In practice, for example after having joined the protection ring nut 60 and the pressing element 50 together by means of the constraining means, it is sufficient to axially insert the free end of the threaded stem 40 of the through hole 62 and, from it, within the inlet cavity 510 of the pressing element 50 until the male thread 41 enters the spindle nut 51.

Subsequently, in order to quickly approach the second surface 611 of the protection ring nut 60 to the visible surface of the tiles P, it is sufficient to impart a (right-handed) torque on the upper shank 516, so that the spindle nut 51 engages the male thread 41 of the threaded stem 40 and, preferably spontaneously, the pressing element 50 quickly screws onto the threaded stem 40.

The axial (spontaneous) travel of the pressing element 50 is interrupted when the second surface 611 of the protection ring nut 60 reaches the visible surface P2 of one or more of the tiles P axially superimposed on it.

At this point, the person in charge of the installation, by activating the rotation of the pressing element 50, for example holding the protrusions 511 with his fingers, screws the latter onto the threaded stem 40 so as to exert a gradual pressure, suitably calibrated and controllable, on the visible surface P2 of all the tiles P on which the second surface 611 of the protection ring nut 60 rests.

During said screwing/tightening rotation, the protection ring nut 60 remains stationary (integral with the tiles P and/or the threaded stem 40 and with the separator element 30) although it can slide axially.

In practice, the second surface 611 defines a resting (anti-sliding) surface adhering to the visible surface P2 of the tiles P on which it rests which prevents the protection ring nut 60 from being able to rotate even if it is subject to a torque due to the sliding contact between the planar end 513 of the pressing element 50 and the first surface 610 of the protection ring nut 60.

The planar end 513 of the pressing element 50, on the other hand, slides during the screwing rotation which allows the tightening of the pressing element 50 and—therefore—the levelling of the tiles P, on the first surface 610 of the protection ring nut 60, de facto not interfering with the visible surface P2 of the tiles P themselves.

Finally, when the adhesive has consolidated and set on the installation surface of the tiles P, it is proceeded with breaking the separator element 30, for example with a kick, along the predetermined fracture line or section 34, thus removing the same separator element 30, with the pressing element 50 screwed onto the threaded stem 40, in order to be able to fill the joints between the tiles P without the base 20 being visible on the finished surface.

In order to be able to reuse the pressing elements 50, with the relative protection ring nuts 60, it is sufficient to remove the threaded stem 40 from the engagement with the spindle nut 51 for example to impart a (left-handed) torque on the upper shank 516, so that the spindle nut 51 is unscrewed from the male thread 41 of the threaded stem 40 quickly (and spontaneously).

The invention thus conceived is susceptible to several modifications and variations, all falling within the scope of the inventive concept.

Moreover, all the details can be replaced by other technically equivalent elements.

In practice, the materials used, as well as the contingent shapes and sizes, can be whatever according to the requirements without for this reason departing from the scope of protection of the following claims.

The invention claimed is:

1. A levelling spacer device for the application of slabs for covering surfaces, comprising:

a base having a lower surface and an opposite upper surface and defining a resting plane for an application surface of at least two slabs that are adjacent and placed side by side with respect to a tiling direction;

a separator element, which rises up from the upper surface of the base and is adapted to slot between facing side edges of said two slabs placed side by side along the tiling direction, wherein the separator element comprises a main zone provided with two side faces that are parallel to one another, perpendicular to the tiling direction and square-angled with respect to the resting plane, wherein a distance between the faces of the separator element defines a first thickness of the main zone of the separator element;

a threaded stem that rises up from the separator element with screwing axis perpendicular to the resting plane;

a pressing element able to screw into the threaded stem;

at least one corner spacer that rises up from the upper surface of the base and is joined thereto and is configured to come into contact with edges perpendicular to the facing side edges of the slabs for the alignment thereof along a direction perpendicular to the tiling direction, wherein the corner spacer comprises two side edges that are parallel to each other, perpendicular to the resting plane and square-angled with respect to the faces of the main zone of the separator element;

wherein the separator element comprises a central zone proximal to the base and having a non-zero second thickness, wherein the non-zero second thickness is smaller than the first thickness; and wherein the corner spacer branches from the central zone and has a longitudinal axis perpendicular to the side faces of the main zone.

2. The device according to claim 1, wherein the central zone surrounds an axial end of the corner spacer on the perimeter, at least on three sides, and is in turn surrounded on the perimeter by the main zone.

3. The device according to claim 1, wherein the central zone extends in height, along a first direction perpendicular to the resting plane, up to a level higher than a maximum height of a top wall of the corner spacer with respect to the resting plane.

4. The device according to claim 1, wherein the central zone extends in width, along a second direction parallel to the resting plane and perpendicular to the longitudinal axis of the corner spacer, for a width greater than a maximum thickness of the corner spacer defined by the distance between the two side edges of the corner spacer.

5. The device according to claim 1, wherein the main zone comprises two legs which are joined to the base and laterally delimit the central zone.

6. The device according to claim 5, wherein the main zone comprises a crosspiece joined superiorly to the top of the legs which superiorly delimits the central zone.

7. The device according to claim 5, wherein the separator element has a predetermined fracture line or section, wherein the predetermined fracture line or section has two side stretches intersecting the main zone and joining the central zone, the maximum height of the side stretches is smaller than a maximum height of a top wall of the corner spacer with respect to the resting plane.

8. The device according to claim 7, wherein the predetermined fracture line or section has a third thickness smaller than the first thickness.

9. The device according claim 8, wherein the third thickness is greater than or equal to the non-zero second thickness.

10. The device according to claim 1, wherein the central zone comprises at least one fracture guide element comprising a perimeter crossing guide hole contained in the central zone.

* * * * *